United States Patent [19]

Benke et al.

[11] 4,276,530

[45] Jun. 30, 1981

[54] VAPOR-COOLED ELECTRICAL APPARATUS

[75] Inventors: Frank W. Benke; Curtis L. Moore, both of Hermitage, Pa.

[73] Assignee: Electric Power Research Institute, Inc., Palo Alto, Calif.

[21] Appl. No.: 75,768

[22] Filed: Sep. 17, 1979

[51] Int. Cl.[3] ..... H01F 27/18

[52] U.S. Cl. ..... 336/58; 165/104.21; 174/14 R; 174/15 R

[58] Field of Search ..... 174/14 R, 15 R, 16 R; 165/105, DIG. 24; 336/57, 58; 361/385

[56] References Cited

U.S. PATENT DOCUMENTS

| | | | |
|---|---|---|---|
| 2,292,337 | 8/1942 | Ford | 174/14 R |
| 2,342,723 | 2/1944 | Buttner et al. | 174/14 R X |
| 2,711,882 | 6/1955 | Narbutovskih | 336/57 X |
| 3,229,023 | 1/1966 | Bolton et al. | 174/14 R |
| 4,145,679 | 3/1979 | Mitchell, Jr. | 336/58 X |

*Primary Examiner*—Laramie E. Askin
*Attorney, Agent, or Firm*—D. R. Lackey

[57] ABSTRACT

A water collector for vapor-cooled electrical apparatus which is hermetically sealed to the atmosphere. The flow of vapor through the water collector is generated by the condensation of the vapor into a liquid and is continuous during operation of the apparatus. A storage chamber may be sized to contain all of the water collected during the lifetime of the apparatus or the water may be periodically eliminated from the system.

6 Claims, 3 Drawing Figures

VAPOR-COOLED ELECTRICAL APPARATUS

BACKGROUND OF THE INVENTION

1. Field of the Invention

This invention relates in general to vapor-cooled electrical apparatus and in particular to means for removal of moisture from such apparatus.

2. Description of the Prior Art

The combination of gas/vapor medium has proven to be a viable alternative to oil as a dielectric/cooling medium to be used in transformers, as well as other electric apparatus. The limiting factor retarding widespread use has been of an economic nature, i.e., oil is but a fraction of the cost of known vapor alternatives. With the increased efforts toward the development of nonflammable transformers that are environmentally acceptable, substantial research and development has highlighted the increased heat transfer capability of the vapor-cooled medium, while keeping the cost competitive with oil.

The dielectric strength as well as the lifetime of an electric insulation medium may be increased by removal of moisture from the medium. These phenomena were recognized by the transformer industry since its infancy and measures for moisture removal were taken since the beginning of the industry for the oil-filled units. Since the oil-filled units were generally vented to the atmosphere, these measures consisted of removal of the water vapor from the incoming air and/or removal of the absorbed water from the oil, usually by placing a desiccant material within the transformer, or removing the oil and reprocessing it.

New fire and explosion resistant transformers utilizing vapor-cooling rather than oil immersion must also have a method of moisture removal but now a new parameter is involved. Instead of being vented to the atmosphere as the oil immersion units, these new transformers are hermetically sealed systems since they utilize a vapor for the dielectric cooling medium.

In the prior art steps were taken to alleviate moisture problems in sealed systems by drying the components thoroughly before introducing the dielectric fluid and sealing the transformer. This technique did not suffice however, as predrying never removed all of the moisture present, and cellulose, a common material used for insulating the electrical windings, evolves water as a product of aging. This water promotes chemical reaction and further aging of the cellulose and further production of water. As mentioned previously, elimination of the water produced has been a continuing problem.

Known arrangements for removal of moisture from vapor-cooled apparatus include placing a desiccant material in the apparatus and placing a water vapor pervious membrane over an opening in the sealed container to transmit water vapor to the atmosphere while retaining all other materials inside the apparatus, this latter method employing a semi-sealed container. The problems involved are how to determine the necessary quantity of desiccant to remove moisture for the expected lifetime of the apparatus and how to limit the reverse flow of water vapor from the atmosphere through the membrane into the system.

Accordingly, it would be desirable to provide a simple and efficient means for separation, containment and subsequent elimination of water vapor from a hermetically sealed vapor-cooled apparatus.

SUMMARY OF THE INVENTION

Briefly, the present invention is a new and improved arrangement for removing water vapor from vapor-cooled hermetically sealed electrical apparatus.

More specifically, the invention is susceptible of being reduced to an add-on accessory wherein the vapors from the apparatus condense into liquid dielectric and trace amounts of water. Upon condensation the liquid dielectric and the water separate—the liquid dielectric returning to the system and the water being held for subsequent elimination from the system. All that is required for the successful operation of the invention is that the condensing unit or surface be located where the ambient temperature is below the condensation point of water and the dielectric liquid employed, and that the dielectric liquid be immiscible in and of different density than water. An external pump for circulating the vapors through the moisture collector is not necessary, as self circulation is promoted by the rapid change in volume upon condensation of the vapors.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Prototype models of the new fire-resistant transformers were life tested and then subjected to laboratory tests. Failures occurred on the dielectric test and and impulse tests that were subsequently identified as water caused or water related. A crucial step for acceptance and reliability of such transformers was the development of a method for eliminating the moisture therefrom. The extensive array of moisture removal apparatus and techniques for oil-filled apparatus could not be adapted to the new transformer because here a vapor dielectric medium and a corresponding sealed container rather than a liquid dielectric and a vented container were involved.

It was essential then that the water elimination means operate in a hermetically sealed vapor medium. In addition, the moisture collector had to be adaptable to several proposed condensable dielectric vapors, in combination with one of more non-condensable dielectric gases used for cold-start conditions, that were to be used in different sizes and types of transformers. The moisture collector then was required to be an add-on accessory rather than an integral part of the transformer tank. The initial screening process narrowed the selection of the liquid dielectrics to $C_8F_{16}O$ (a fluorocarbon liquid designated as $FC_{75}$ by the 3M Company) and $C_2Cl_4$ (perchloroethylene). The transformer insulating gas selected was $SF_6$ (sulfur hexafluoride). Additional candidate material selections may follow further developments. Several of the proposed transformers were not to have any moving parts (i.e., no dielectric pump), therefore a means of circulation through the moisture collector without moving parts was required. The design described below fulfilled all of the above requirements.

Figure 1:
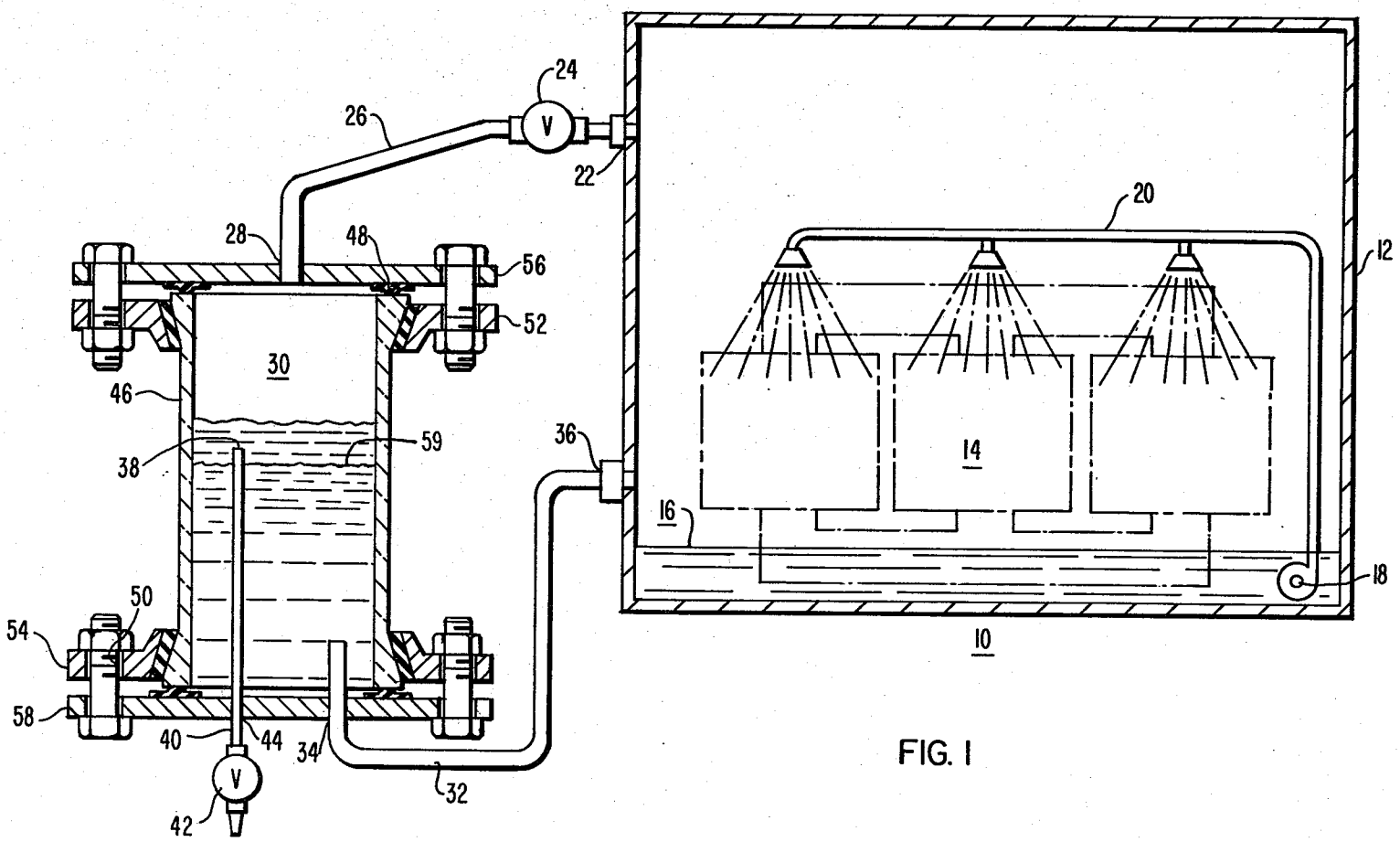
FIG. 1 is a fragmentary elevational view of vapor-cooled electrical apparatus which may be constructed according to the teachings of the invention with the tank and external water collector condenser unit shown in cross section.

Referring now to the drawings and FIG. 1 in particular, there is shown a diagrammatic representation of a three-phase power transformer 10, which is of the gas/-vapor type. Transformer 10 includes a tank or casing 12 having a magnetic core-winding assembly 14 disposed therein, and a liquid dielectric 16, such as $C_2Cl_4$, $C_8F_{16}O$, or the like, which is vaporizable within the normal operating temperature range of the magnetic core-winding assembly 14. The liquid dielectric 16 is distributed over the magnetic core-winding assembly 14 by any suitable means, such as via a pump 18 and piping means 20. In addition to the vapors of liquid dielectric 16, tank 12 may include a non-condensible gas, such as $SF_6$, to provide insulation during start-up of the transformer 10, as well as trace amounts of water vapor. The condensable dielectric vapor and water moisture from the upper portion of the hermetically sealed tank 12 pass through outlet 22, adjustable valve or fixed orifice 24, input conduit 26 and inlet 28 into water collector 30. Conduit 26 may be formed of a 6-foot length of coiled $\frac{3}{8}$ inch tubing or a straight 3-foot length of $\frac{1}{2}$ inch pipe or other suitably sized conduit. Water collector 30 is located at a sufficient distance from tank 12 such that the ambient temperature is below the condensation point of water, thereby also being below the condensation point of the vapor, since a liquid dielectric is chosen that has a boiling point near that of water.

By the time the vapor passes through inlet 28 it will have been cooled near or below its boiling point whereupon it condenses in water collector 30 into both liquid dielectric and trace amounts of water. The liquid dielectric either $C_8F_{16}O$ or $C_2Cl_4$ being heavier and immiscible with water will form an individual layer of fluid on the bottom of the water collector 30 and the water will form an individual layer directly above, the liquid dielectric/water interface being shown at 59.

Return conduit 32 exiting through outlet 34 transports the condensed liquid dielectric through a pipe trap type of path back into the tank 12 at inlet 36 above the sump level. The pipe trap path ensures that (1) no water is returned to the system, (2) all dielectric liquid except for that retained in the pipe trap is returned to the system and (3) the liquid dielectric level in the water collector is maintained at a level such that the head of the dielectric liquid plus the head of the water above, equals the head of the returning dielectric liquid in conduit 32. This dielectric level then defines the lower water level in the water collector. The inlet 38 of a drain conduit 40 is located slightly above the level of inlet 36 so that dielectric liquid cannot be drained. Drain valve 42 controls the elimination of collected water through outlet 44 in the drain conduit 40. Return conduit 32 and drain conduit 40 may be any suitably sized tubing. In the preferred embodiment, $\frac{1}{4}$ inch copper tubing was used for the return conduit 36, and $\frac{1}{8}$ inch tubing was used for the drain conduit 40.

If visual inspection of the water level is desired, the sidewall 46 of the water collector 30 may be made of glass and sealed with suitable gaskets such as gaskets 48 and suitable clamping means, such as bolts 50 clamping upper and lower flanges 52 and 54 to upper and lower end caps 56 and 58, respectively. The water drain conduit 40 and drain valve 42 may be dispensed with if the water collector 30 is sized large enough to contain all the water collected during the lifetime of the apparatus. However, it is desirable to periodically remove the water from contact with the liquid dielectric, as there is never complete immiscibility. Since the transformer 10 operates within a hermetically sealed container, all conduit inlets and outlets as well as the water collector 30 must be of gastight construction.

The vapor-liquid circulation cycle is initiated by the vapor pressure that exists in tank 10 and is sustained by the rapid and large change of volume of the dielectric during condensation. When the vapor medium goes through the vapor-to-liquid condensation, the reduction in volume is on the order of 100:1 and induces a slight pressure differential in the water collector 30 and input conduit 26. The cooling of the vapors alone even without condensation will produce circulation through the water collector. With pure vapor in a gas space, there is no conventional circulation of the coolant vapor. The vapors flow freely toward any part of the system from which heat is being removed (by external cooling), and will give up this heat by condensing back into liquid. In operation this self-circulation of the dielectric and water vapors is so rapid as to raise the temperature of the water collector above the boiling point of the vapors such that it will function as an external heat exchanger. Consequently this circulation must be restricted. The circulation is restricted by two methods. The first is by locating outlet 22 within the upper $\frac{1}{3}$ of the transformer tank because there is a marked reduction in vapor-gas temperature at locations above the active area of the mid-section of the transformer. The second means of restricting the circulation is by the fixed orifice or adjustable valve 24 located in input conduit 26.

Figure 2:
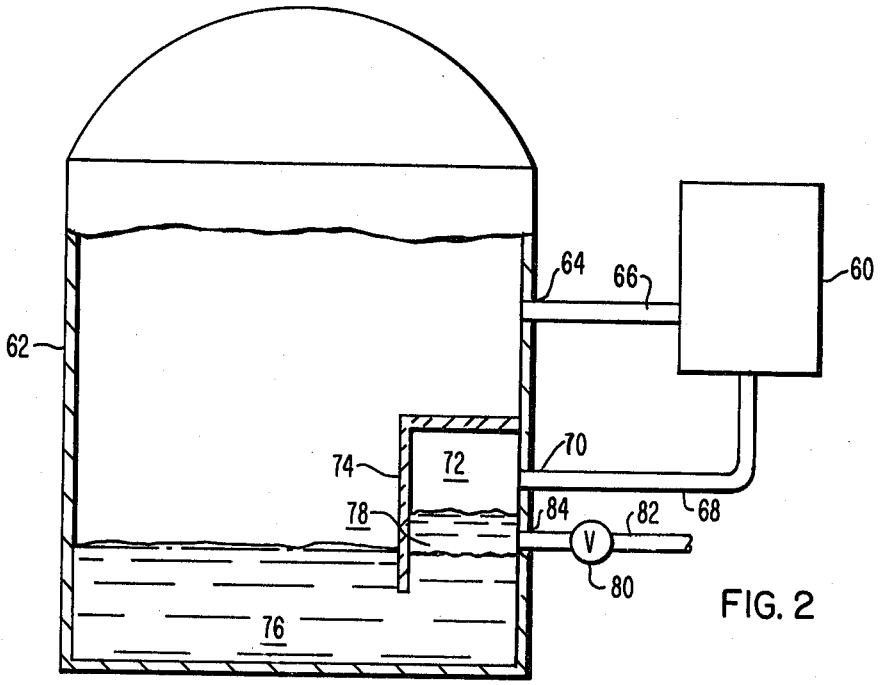
FIGS. 2 and 3 are cross-sectional views of other embodiments of the invention.

FIG. 2 is a cross-sectional view of another embodiment of the invention wherein external condenser 60 promotes a circulation through the vapor/liquid condensation cycle described above. Liquid dielectric and water vapors pass through tank 62 at gas tight tank outlet 64, through input conduit 66 into condenser 60, condensing the vapors into dielectric liquid and water. The liquid dielectric and water returns to the tank through conduit 68 and gas tight tank inlet 70. Just inside tank inlet 70 is containment chamber 72 that is separated from the rest of the tank by insulated barrier 74 that can be made of suitable insulating material that is compatible with the dielectric medium employed. For transformers employing either $C_8F_{16}O$ or $C_2Cl_4$, epoxy foam is a suitable barrier material. The chamber 72 is closed on the bottom by the level of liquid dielectric 76 in the sump of the tank 62. The water 78 will be contained above the designated dielectric sump level and may be drained periodically by means of drain valve 80 and conduit 82 leaving tank 62 at gas tight outlet 84.

Figure 3:
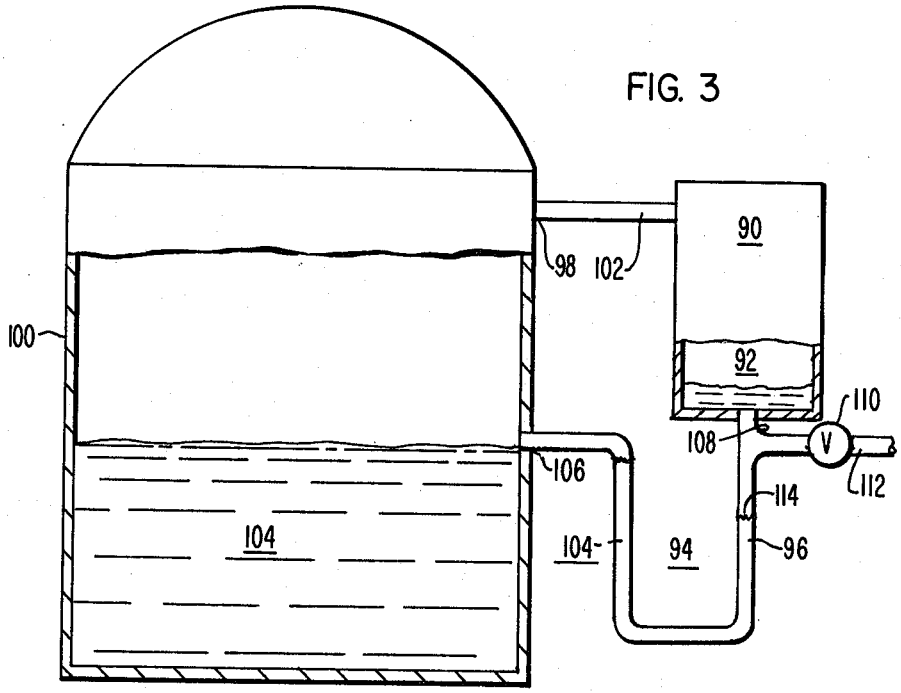

FIG. 3 depicts an external condensing unit wherein the bottom of the condenser 90 forms the necessary water containment chamber 92 and pipe trap 94 by means of return conduit 96. Liquid dielectric and water vapors pass through gas tight tank outlet 98 from tank 100 through input conduit 102 into condenser 90 whereupon the vapors condense into liquid dielectric and water. The condensed liquid dielectric 104 alone returns to tank 100 at gas tight tank inlet 106 through conduit 96. The water containment chamber 92 is integral with the condenser 90, the water being contained above the residual liquid dielectric 104 in the pipe trap 94. The water/liquid dielectric interface 114 will again fluctuate depending on the relative heads of water and liquid dielectric formed in pipe trap 94. Water may be eliminated through gas tight outlet 108 by means of drain valve 110 and conduit 112.

Although the preferred embodiments described here employ a dielectric liquid heavier than water because these liquids were developed for certain fire resistant transformers, this invention is not limited to such heavy dielectric mediums. Neither is it limited to transformer applications. Rather, this invention is broadly applicable to any electrical apparatus utilizing a dielectric vapor that is immiscible in water and of different density. If the liquid dielectric density is less than that of water, the return and drain conduits above-described would simply be reversed.

In conclusion this invention discloses a new and unique means for removing water moisture from a hermetically sealed and operating dielectric vapor cooled electrical apparatus. The apparatus does not have to be taken out of service for periodic treatment of the dielectric fluid. Rather, during normal operation, the liquid dielectric and water condense and separate, with only the liquid dielectric being returned to the apparatus. The collected water may be stored or preferably eliminated from the system. The means employed is a simple add-on type of accessory that has no moving parts and is adaptable for use with different dielectric liquids and different electrical apparatus. The entire system including the water collector functions in a hermetically sealed container and is impervious to outside conditions such as ambient vapor pressure.

We claim as our invention:

1. Vapor-cooled electrical inductive apparatus, comprising:

a hermetically sealed flowpath, said flowpath including a tank, and water collecting means external to said tank, a magnetic core-winding assembly in said tank adapted for energization by a source of electrical potential, a liquid dielectric containing trace amounts of water disposed in said tank to a predetermined level, said liquid dielectric and water being immiscible and of different densities, said magnetic core-winding assembly, when energized, heating said liquid dielectric and water sufficiently to vaporize said liquid dielectric and water into the space above the liquid level in said tank, said hermetically sealed flowpath being constructed to initiate a predetermined self circulating flow of vapor from said tank to said water collecting means, and liquid from said water collecting means to said tank, and further constructed to deliberately restrict the flow of vapor in said flowpath to provide a self circulation rate which results in the water collecting means functioning as a water collector, rather than as a heat exchanger, with the temperature of the water collecting means being maintained below the condensation temperature of said vaporized liquid dielectric and water, means for segregating the water vapor which condenses in said water collecting means and for preventing it from re-entering the self circulating flowpath, and means for withdrawing said segregated condensed water vapor from said water collecting means.

2. The vapor-cooled electrical inductive apparatus of claim 1 wherein the dielectric and water vapors condense and separate to define a liquid dielectric-water interface level within the water collecting means, and wherein the means which segregates the condensed water vapor includes piping means in fluid flow communication between the condensed liquid dielectric in the water collecting means and the tank, with said liquid dielectric-water interface level being at an elevation, relative to the elevation of the inlet of said piping means to the tank, which is selected to return only the condensed liquid dielectric to the tank.

3. The vapor-cooled electrical inductive apparatus of claim 2 wherein the liquid dielectric has a greater density than water, and the piping means is in the shape of a pipe trap, one end of which is located in the water collecting means below the level of the liquid dielectric-water interface, and the other end of which is located above the level of the liquid dielectric in the tank, but below the level of the liquid dielectric-water interface.

4. The vapor-cooled electrical inductive apparatus of claim 2 wherein the means for draining the condensed water from the water collecting means includes a drain conduit having first and second ends, with the first end being located on the water side of the liquid dielectric-water interface level in the water collecting means, and with the second end being located outside the water collecting means.

5. The vapor-cooled electrical inductive apparatus of claim 1 wherein the construction of the hermetically sealed flowpath which restricts the flow of the liquid dielectric and water vapors to the water collecting means includes a fixed orifice.

6. The vapor-cooled electrical inductive apparatus of claim 1 wherein the construction of the hermetically sealed flowpath which restricts the flow of the liquid dielectric and water vapors to the water collecting means includes an adjustable valve.

* * * * *